US007078605B2

(12) United States Patent
Love

(10) Patent No.: US 7,078,605 B2
(45) Date of Patent: Jul. 18, 2006

(54) INVERSELY PROPORTIONED MOUTHPIECES

(76) Inventor: Robert Worth Love, 326 Meadowgrove Dr., Englewood, OH (US) 45322

( * ) Notice: Subject to any disclaimer, the term of this patent is extended or adjusted under 35 U.S.C. 154(b) by 64 days.

(21) Appl. No.: 10/730,605

(22) Filed: Dec. 8, 2003

(65) Prior Publication Data

US 2005/0120861 A1 Jun. 9, 2005

(51) Int. Cl.
*G10D 9/02* (2006.01)

(52) U.S. Cl. ..... 84/398

(58) Field of Classification Search ..... 84/398, 84/399, 387 R

See application file for complete search history.

(56) References Cited

U.S. PATENT DOCUMENTS

| | | | | |
|---|---|---|---|---|
| 1,012,140 A | | 3/1911 | Kunze | |
| 1,178,513 A | | 4/1916 | George | |
| 2,273,177 A | | 2/1942 | Calicchio | |
| 2,758,497 A | | 8/1956 | Sarad | |
| 2,917,964 A | | 8/1959 | Cassinelli | |
| 3,370,500 A | * | 2/1968 | Zwolak | 84/398 |
| 3,808,935 A | | 5/1974 | Reeves | |
| 4,258,605 A | * | 3/1981 | Lorenzini | 84/386 |
| 4,395,933 A | | 8/1983 | Shepley | |

OTHER PUBLICATIONS

Lyons and Healy Co., Band Instruments, Uniforms, and Trimmings catalog 1883-1884 edition, p. 93, USA.

Sears Roebuck & Co., catalog, 1897, p. 537, "Band Instrument Mouthpieces",USA.

C. G. Conn, product catalog, circa 1908, "C.G. Conn's New Invention Mouthpieces", USA.

J.W. Jenkin's Sons Music Co., catalog, circa 1910, USA "The York Perfected Mouthpieces" p. 90 (upper 2/3 of page).

J.W. Jenkins Sons Music Co., catalog, circa 1930, USA "Band Instrument Furnishings", "The Celebrated Vincent Bach Mouthpieces".

Czechoslovak Music Co., New York, catalog, circa 1932, USA "Genuine Bach Mouthpieces".

Continental Music Company, catalog, circa 1932-1933, p. 48, USA "Bach Mouthpieces".

H.N. White Co., catalog, Sep. 1936, USA "New King Modern Type Mouthpieces" (lower right corner).

Vincent Bach, Embouchure and Mouthpiece Manual, 1956, USA, pp. 20-22, "Outer Dimensions of Bach Mouthpieces".

Robert W. Love photograph of early, pre-invention experimental proptotypes, Feb. 1, 2004.

Yamaha Corporation, catalog WA-9R, circa 1998, "printed in Japan" "Why Not Try the Best", "Yamaha Mouthpieces for Brass Instruments".

(Continued)

*Primary Examiner*—Kimberly Lockett
(74) *Attorney, Agent, or Firm*—R. William Graham

(57) ABSTRACT

Mouthpieces for brass wind musical instruments are shaped so the physical length of a mouthpiece body (40, 50, 60, 70, & 80) is inversely-proportional to the volumetric size of a corresponding cup-chamber (42, 52, 62, 72, & 82). Methods for constructing separate sets of such mouthpieces for each kind of brass wind instrument are disclosed. Other embodiments include variations like multi-section components and alternative backbore shapes.

7 Claims, 3 Drawing Sheets

OTHER PUBLICATIONS

Boosey & Hawkes Group, Dennis Wick Mouthpieces & Mutes, catalog, circa 2001, inset comparison chart from p. 7 for Cornet mouthpieces.

Vincent Bach, Mouthpiece Manual, circa 2003, p. 32, USA "Outer Dimensions of Bach Mouthpieces".

David G. Monette Corporation, webpage, "Monette Concepts", USA, printed Dec. 9, 2003, p. 1 & 2, The Development of Monette Trumpet Mouthpieces.

The Brasswind Catalog, Fall/Winter 2003, pp. 64 to 72, , USA "Mouthpieces" (The Brasswind & Woodwind Corp., South Bend, Indiana).

Bob Reeves Company Advertisement, in "Journal of the International Trumpet Guild", Spring, 2003, USA, "If you only want a trumpet mouthpiece . . . ".

GRMOUTHPIECES.COM, website article, "C Trumpet Mouthpiece", p. 2 of 2, by Gary Radtke, printed Dec. 12, 2003 USA.

GRMOUTHPIECES.COM, website article, "GR Trumpet Mouthpieces", p. 1 of 2, by Gary Radtke, printed Jan. 29, 2004 USA.

GRMOUTHPIECES.COM, website article, "GR Mouthpiece Backbores", p. 1 of 1, by Gary Radtke, printed Jan. 29, 2004 USA.

* cited by examiner

Prior Art

Fig. 9

Figure 3:
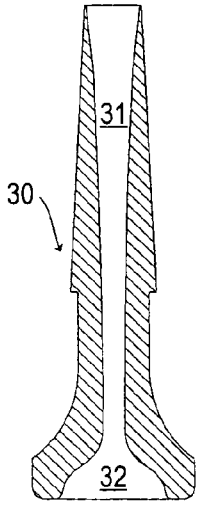
Figure 4:
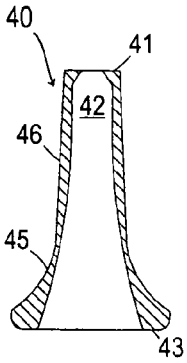
Figure 5:
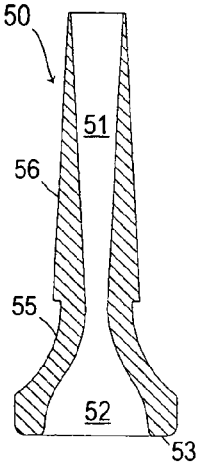
Figure 6:
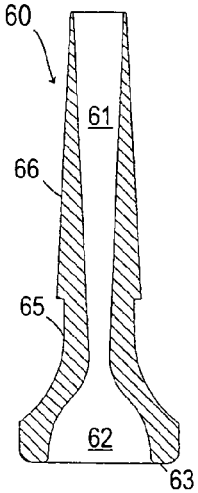
Figure 7:
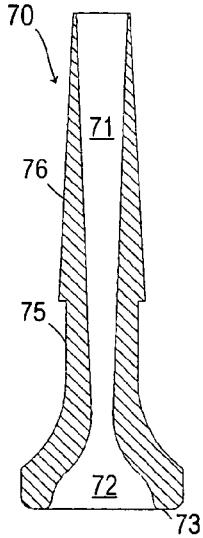
Figure 8:
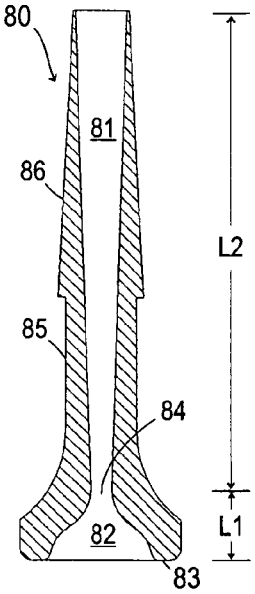

| Selected Mouthpiece | Tuning Slide Extension | Overall Length (L3) | Cup Volume (v1) |
|---|---|---|---|
| Yamaha 14E4 (Fig.1) | 0.8cm | 8.75cm | 1.4cc |
| Yamaha 14C4 (Fig. 2) | 1.2cm | 8.75cm | 1.1cc |
| Yamaha 14A4a (Fig. 3) | 1.4cm | 8.75cm | 0.7cc |
| Fig. 4 | 1.1cm | 4.39cm | 3.4cc |
| Fig. 5 | 1.1cm | 7.63cm | 1.7cc |
| Fig. 6 | 1.1cm | 8.16cm | 1.4cc |
| Fig. 7 | 1.1cm | 8.87cm | 1.0cc |
| Fig. 8 | 1.1cm | 9.73cm | 0.6cc |

INVERSELY PROPORTIONED MOUTHPIECES

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND—FIELD OF INVENTION

The invention relates to mouthpieces for musical instruments known as brass wind instruments such as trumpet, trombone, tuba, and similar kinds.

BACKGROUND OF THE INVENTION—PRIOR ART

Figure 2:
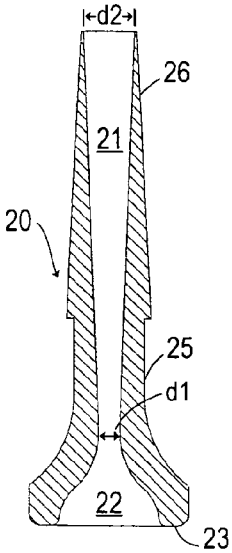
Fig. 2 Prior Art

Mouthpieces for brass wind instruments have been produced for thousands of years. Most mouthpieces have been shaped from solid brass rod in which contiguously conjoined elements of a rim, a cup-chamber, a backbore-chamber, and an external end-taper blend together within undivided bodies. FIG. 2 shows interrelationships among these regions of a typical mouthpiece body. Brass-wind mouthpieces were not considered to be interchangeable between brands of similar instruments until design standards of the 20$^{th}$ Century gained in popularity. Lack of interchange-ability had occurred because each manufacturer designed mouthpieces for use with their own instruments, mouthpiece length was considered arbitrary, manufacturers used a variety of end-tapers to connect mouthpieces with their instruments, and manufacturers expected musicians to use mouthpieces that were supplied with each instrument.

Since the early 20$^{th}$ Century, interchangeability of brass-wind mouthpieces has been greatly facilitated by two design practices. Manufacturers started to use (1) generally accepted standards for overall length and external end-taper, in conjunction with (2) a common principle for "balancing" acoustical characteristics of a cup-chamber with a backbore-chamber within each mouthpiece body. Pages 20–22 of the "Embouchure and Mouthpiece Manual" by Vincent Bach, in calendar year 1956, show general standards for overall length and end-taper size that have been adopted by most manufacturers of modern brass-wind mouthpieces.

Figure 1:
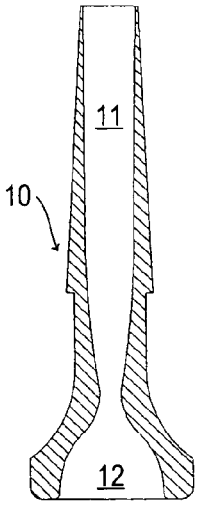
Fig. 1 Prior Art

Mouthpieces with large cup-chambers produce a more mellow timbre whereas shallow-cupped mouthpieces produce more brilliant sounds. In traditional fixed-length mouthpieces, designers follow an unnamed yet ancient acoustic principle to balance the sizes of cup-chambers and backbore-chambers. I call it the "principle of direct proportionality". Longitudinal centerline sections in FIG. 1 to 3 illustrate this principle for trumpet mouthpieces. Large cup-chamber 12 is acoustically balanced with a proportionately large backbore-chamber 11 as shown in FIG. 1. Conversely, small cup-chamber 32 is acoustically balanced with a proportionately small backbore-chamber 31 as shown in FIG. 3. FIG. 2 shows medium size cup-chamber 22 acoustically balanced with medium size backbore-chamber 21. Similar enlargements or reductions in size of the narrow region between cups and backbores are also used in some mouthpieces. Current manufacturers utilize the principles of fixed length and direct proportionality to design a similar range of mouthpieces, separately, for each of the different kinds of brass wind instruments, from trumpet to tuba. In further discussions, such a range of instrument-specific mouthpieces, like FIG. 1 to 3, is referred to as a "set" of mouthpieces.

The Limitations of Fixed Length and Direct Proportionality

The same standard design principles and manufacturing practices that facilitate mouthpiece interchangeability between brands of similar instruments also cause several additional problems for the modern instrumentalist:

- Performers often have difficulty in selecting a mouthpiece because, with standard lengths, mouthpieces often look similar to each other. Even acoustically dissimilar mouthpieces may look identical because of unseen differences inside the narrow backbore-chamber. Confusion abounds.
- The range of tonal qualities, or timbre, available from each set of conventional mouthpieces is limited.
- When switching from a large-cup mouthpiece to one with a small cup, a musician must retune an instrument by pulling out its tuning slide. This is both time consuming and inconvenient during a musical performance.
- Two large gaps are created within an instrument when the tuning slide is pulled out at an excessive distance to compensate for usage of small-cupped mouthpieces. These gaps adversely affect responsiveness and intonation for some pitches.
- Brass-wind performers generally have little knowledge of how mouthpieces are designed, so they often resort to a "trial and error" method of choosing a mouthpiece. This approach can become frustrating and very expensive.
- The large differences of internal air volume among current sets of mouthpieces lead to variations of perceived responsiveness and intonation of an instrument, especially for the highest and lowest notes within its normal musical range.

A few additional standards have been established beyond those of the Vincent Bach Corporation. For cornet there are two widely-accepted length standards that have evolved from general "English" and "French" styles of the late 19$^{th}$ Century. Refined sets of these two styles are now described as long-shank or short shank mouthpieces. Lengths of these sets have stabilized at about 7 centimeters versus about 6 cm, respectively. One Japanese company offers a separate set for each length, but most companies, including Vincent Bach Co., favor only long-shank lengths for cornets. A similar set of short-shank mouthpieces for trumpet, at about 7 cm, have been introduced by the Bob Reeves Company in about calendar year 2001. Each set of these mouthpieces share the limitations stated above and variations within each set all follow the ancient principle of direct proportionality. A lack of consistent features amongst these sets cause more confusion for musicians.

Figure 10:
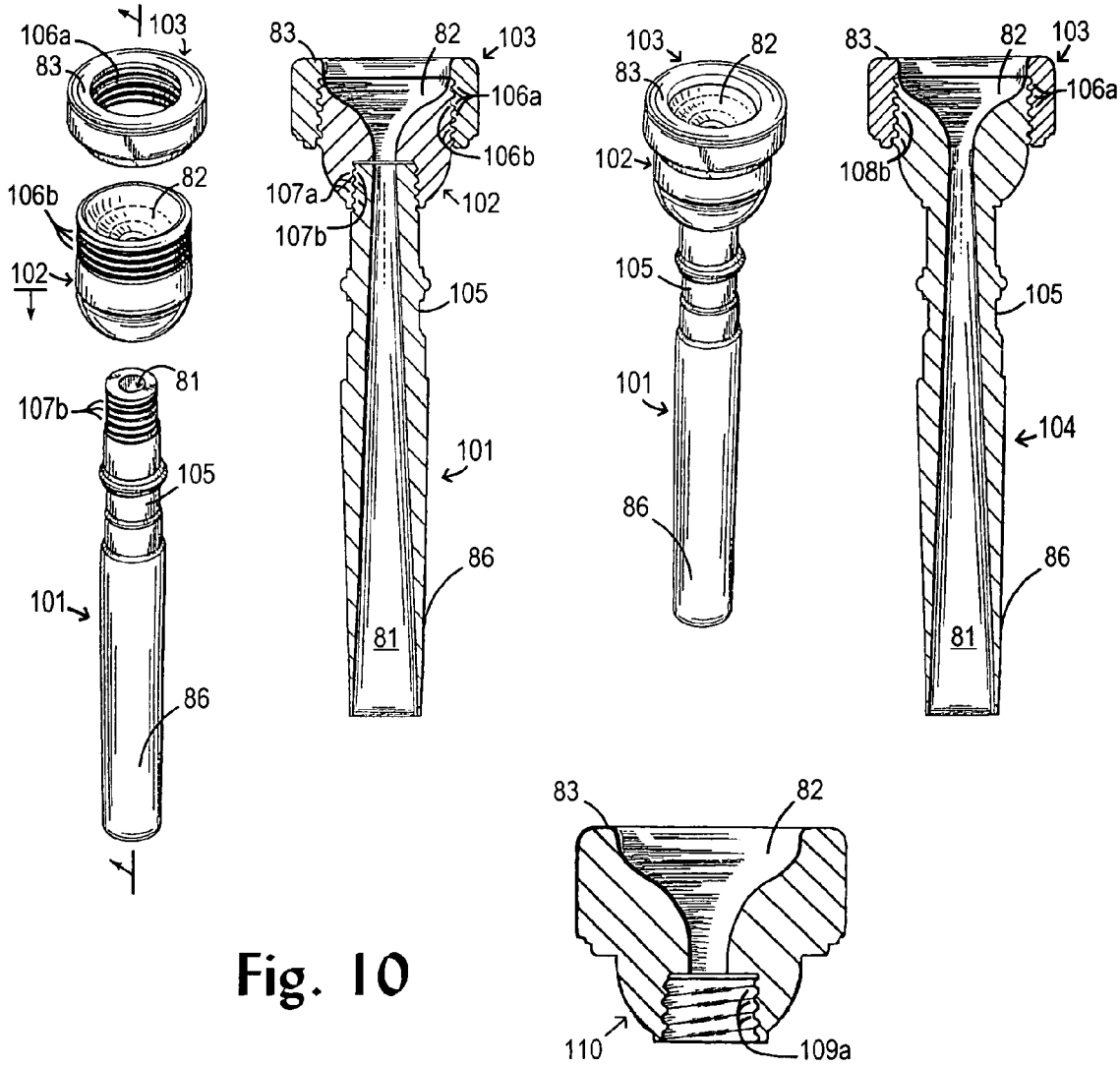

A few inventors have utilized changeable mouthpiece lengths. In U.S. Pat. No. 1,012,140 (1911), August Kunze Claimed a single cup-chamber with mutli-length extensions to change timbre and blowing resistance in cornets for different performance circumstances. Similarly, U.S. Pat. No. 1,178,513 of Charles E. George (1916) shows three-section mouthpieces for matching single rims to similarly sized mouthpiece parts, that is, trumpet rims with cornet parts, or trombone rims with euphonium parts, etc. In U.S. Pat. No. 2,917,964, (1959) Alfred Cassinelli showed some interest in the control of internal air volume, but he only did this to allow a single rim section to be used across several different kinds of instruments, like trumpet rims for trombone bodies. FIG. 10 provides an example of how rims, cups, and backbores sections are typically joined for such mouthpieces. The inventions of Kunze, George, and Cassinelli solved problems that are much different in nature and that require multiple components for proper usage.

The David G. Monette Company produces mouthpieces that have a range of physical lengths similar to ones that I disclose later, but their internal proportions follow the patterns of FIG. 1 to 3. Monette says that mouthpiece length should be proportional to the length of an instrument. Thus his piccolo trumpet mouthpieces have a much shorter design length than his mouthpieces for standard B-flat trumpet. Piccolo trumpets measure roughly one-half the length of standard B-flat trumpets. Monette warns musicians to not substitute his longer mouthpieces in place of his shorter ones. I disagree with this approach because Monette uses the same old principle of direct proportionality to balance cup and backbore chambers, regardless of mouthpiece lengths he has chosen to match each separate length of instrument. Monette designs could be greatly improved with methods I disclose.

SUMMARY

The problems described above are solved by balancing cup-chambers and backbore-chambers according to a "principle of inverse proportionality" so that variations of timbre within each set are strongly correlated with systematic variations in mouthpiece length. I describe a simple way to shape (1) brass-wind mouthpieces in which the length of each mouthpiece body is inversely-related to the volumetric size of a corresponding cup-chamber, (2) multiple sets of inversely-proportioned mouthpieces for each kind of brass wind instrument, (3) inversely-proportioned mouthpieces that are fabricated with divisible sections, and (4) inversely-proportioned mouthpieces that incorporate new uses for older methods of adjusting various regions of mouthpieces.

BACKGROUND OF THE INVENTION—OBJECTS AND ADVANTAGES

By conducting research into the acoustic behavior of brass-wind mouthpieces, I have discovered a new acoustic principle for defining their shape. I call it the "principle of inverse proportionality". The discovery here is that (1) mouthpiece lengths should be inversely proportional to the volumetric size of cup-chambers within such mouthpieces, (2) the total volume-of-air within a mouthpiece can be used as a fixed design standard rather than mouthpiece length, (3) mouthpiece length can be treated as a systematic design variable, and (4) total internal volume-of-air should be held more constant for all mouthpiece bodies within an interrelated set, regardless of actual mouthpiece length. These discoveries teach in direct opposition to the old principle of direct proportionality and against observed historical practices for how sets of brass-wind mouthpieces are proportioned.

Accordingly, systematically interrelated sets of multi-length mouthpieces can be created for each kind of brass wind instrument. The first object of the invention is to demonstrate a method that balances cup-chambers and backbore-chambers according to the principle of inverse proportionality. Another object is to describe how separate sets of inversely-proportioned mouthpieces can be created for each kind of brass wind instrument. A further object is to describe how alternative methods create similar sets of inversely-proportioned mouthpieces. A still further object is to adapt useful features from prior-art like adjustable components and divisible mouthpiece sections for new uses.

When these objects are realized the following advantages become apparent:

- Variations in overall mouthpiece length are strongly correlated with variations in the timbre of sound produced with a brass wind instrument.
- A wider range of sonic timbres may be produced when compared with prior-art mouthpieces.
- The selection of a mouthpiece is made simpler because longer mouthpieces sound more brilliant whereas shorter mouthpieces sound more mellow.
- The tuning slide of a brass wind instrument need not be adjusted when switching to other mouthpieces from a fine-tuned set of such mouthpieces.
- Greater constancy of internal air volume and backbore profile helps to eliminate intonation problems that occur amongst existing mouthpieces.
- The final size of backbore-chambers are approximated more closely by calculation, rather than by the repetitious "guess work" of prior art.
- Mouthpieces are constructed for each kind of brass wind instrument so that overall lengths, cup-chamber depths, and timbre of sound are perceived to co-vary in a logical and synergistic manner.
- The mouthpieces may be freely interchanged amongst many brands of instruments while avoiding limitations associated with prior-art designs.

Still further objects and advantages will become apparent from a consideration of the ensuing descriptions and drawings.

DRAWINGS—FIGURES

FIG. 1 A prior-art mouthpiece for trumpet with large proportions

FIG. 2 A prior-art mouthpiece for trumpet with medium proportions

FIG. 3 A prior-art mouthpiece for trumpet with small proportions

FIG. 4 An inversely-proportioned trumpet mouthpiece with a zero-length backbore-chamber FIG. 5 An inversely-proportioned trumpet mouthpiece with an extra-large size cup-chamber FIG. 6 An inversely-proportioned trumpet mouthpiece with a large-size cup-chamber FIG. 7 An inversely-proportioned trumpet mouthpiece with a medium-size cup-chamber FIG. 8 An inversely-proportioned trumpet mouthpiece with a small-size cup-chamber FIG. 9 A comparison of prior-art trumpet mouthpieces with inversely-proportioned trumpet mouthpieces FIG.10 An example of separate sections for a brass-wind mouthpiece

DRAWINGS—REFERENCE NUMERALS

10, 20, 30, 40, 50, 60, 70, & 80=complete, undivided mouthpiece bodies

11, 21, 31, 41, 51, 61, 71, & 81=backbore-chambers

12, 22, 32, 42, 52, 62, 72, & 82=cup-chambers 84=a center-bore

23, 43, 53, 63, 73, & 83=rims 26 46, 56, 66, 76, & 86=end-tapers

25, 45, 55, 65, 75, 85, & 105=decorative regions

L1=length of backbore-chamber L2=length of cup-chamber

101=a backbore section 102=a cup-chamber section 103=a rim section

104=a "bottom section" 110=a "top section"

106*a*, 107*a*, & 109*a*=internal screw-type fasteners

106*b*, 107*b*, & 108*b*=external screw-type fasteners

DETAILED DESCRIPTION—PREFERRED EMBODIMENT

The following first method describes one way to shape a new mouthpiece so its cup-chamber and backbore-chamber are acoustically balanced in accordance with the principle of inverse proportionality. The first method then continues to explain how to create one or more sets of such new mouthpieces. These initial shapes are then "fine-tuned" with minor adjustments if desired. After presenting the first method, a specific example demonstrates how one interrelated set of such multi-length mouthpieces is created.

1. Obtain or create a conventional mouthpiece of standard length for use as an initial reference standard where a rim, cup-chamber, backbore-chamber, and end-taper have medium size characteristics, cooperate well musically, and provide good intonation when played on a typical instrument.
2. Determine the total volumetric size (v1) contained within combined cup-chamber and backbore-chamber regions of the reference mouthpiece body, as if closed at both ends.
3. Measure the smallest diameter of the backbore (d1) at the center-bore of the reference mouthpiece. The center-bore, or throat, is the smallest internal diameter and it is boundary point between the cup-chambers and backbore-chambers. Measure the largest diameter of the backbore (d2) at the small end of the reference mouthpiece.
4. To create a new inversely-proportioned mouthpiece body, first select and shape into a piece of common machining bar-stock (a) a similar rim and (b) a new cup-chamber containing, by choice, either a larger or smaller volumetric size than the cup-chamber of the reference mouthpiece.
5. Determine axial length (L1) of the newly created cup-chamber between the center-bore and the end of the bar-stock at the rim. Measure the volumetric size (v2) within this new cup-chamber.
6. Calculate length (L2) for a new backbore-chamber in the new mouthpiece body by using a transformed formula for the volume of a conic frustum:

$$L2 = \frac{3(v3)}{3.1416(R^2 + rR + r^2)} \text{ where } \begin{aligned} r &= \frac{1}{2}d1 \\ R &= \frac{1}{2}d2 \\ v3 &= v1 - v2 \end{aligned}$$

7. Calculate total length (L3) for the new mouthpiece body by adding L1 and L2. Cut the mouthpiece bar-stock at the length L3 to create the new body.
8. Create a backbore-chamber for the new mouthpiece body shaped as a conic frustum using dimensions d1, d2, and L2 above.
9. Shape a new end-taper for the new mouthpiece body to the same physical dimensions as the end-taper on the reference mouthpiece. Shape and emboss the decorative region of the new body as desired.
10. Play-test the new mouthpiece body with an appropriate instrument. If desired, adjust or fine-tune critical areas of the mouthpiece so it better meets the needs of individual musicians or the requirements of particular brands of instruments. Polish, and electroplate as desired.
11. If desired, repeat steps 4 through 10 to create an correlated set of bodies that have different cup volumes and incrementally distinct lengths. Use steps 1 through 12 to construct a plurality of separate sets for one instrument or a multitude of such sets for all of the different kinds of brass wind instruments utilized in musical performance.
12. To produce similarly-proportioned mouthpieces with differently-shaped rims and cup-chamber diameters, the volumetric size of cup-chamber (v2) is held constant for each change. Cup-chamber diameter is measured where a rim and a cup-chamber blend together.

The creation of a small set of inversely-proportioned trumpet mouthpieces is described here: A popular Vincent Bach Corporation model 7C trumpet mouthpiece (not shown) is chosen as a reference standard (working mouthpiece) to create five new inversely-proportioned trumpet mouthpieces. The 7C is known have a good sound, good intonation, and medium characteristics with regard to cup volume and backbore style. Total internal volume v1 measures about 3.4 cubic centimeters (cc) of air. Dimensions d1=0.37 cm and d2=0.88 cm. Cup-chamber volume=1.1 cc and overall length 8.73 cm. Except for decorative details, the Bach model 7C has features similar to those illustrated in FIG. 2. FIG. 2 is referenced below as a substitute in place of the Bach model 7C not shown.

Using an engine lathe, copy rim 23 and duplicate its shape onto the end of a brass machining rod to create rim 83. Shape and blend a predetermined cup-chamber like cup 82, which is a smaller volumetric variation of cup 22. Measure length (L1) between the axial end of rim 83 and the narrow region of cup 82 at center-bore 84. L1=1.08 cm. Measure volume (v2) of cup 82 and rim 83 as if closed at its large end. v2=0.6 cc. The L2 calculation for backbore-chamber 81=8.65 cm. Determine mouthpiece length L3. L3=1.08+8.65=9.73 cm.

Cut the machining rod at a right angle to a length of about 9.73 cm on the end opposite rim 83. Create backbore 81, with a backbore reamer, in the shape of a conic frustum by using a geometric rotation of diameters 0.37 cm (d1) and 0.88 cm (d2) with L2 length of 8.65 cm to define the size of backbore 81. Shape external end-taper 86 to the standard end-taper dimensions for a trumpet mouthpiece where the smallest diameter=0.97 cm and a larger diameter of the taper=1.097 cm at a distance of 2.54 cm from the 0.97 cm diameter. Taper 86 is continued to about 2.5 cm beyond the 2.54 cm parameter as part of decoration.

Shape decorative region 85 like region 25 to complete a contiguously formed unit like body 80. Create four more mouthpieces by substituting respective cup-volumes (v2) of 3.4 cc, 1.7 cc, 1.4 cc, and 1.0 cc into steps 4 to 10. These cup-volumes are represented as regions 42, 52, 62, & 72 in bodies 40, 50, 60, & 70, respectively. Polish, emboss, and electroplate. Body 40 requires unimportant deviations from steps 4, 8, & 9 because of its short length.

Adjust or "fine-tune" these shapes to meet the requirements of specific instruments or musicians' needs by using normal mouthpiece tools like center-bore reamers, backbore reamers and cup shapers in accordance with traditional adjustment practices. For some instruments, a slight foreshortening of the calculated design lengths may be useful because the first method is intended to apportion any errors of approximation towards excess length, since length cannot be conveniently added to a mouthpiece body. For persons skilled in acoustical measurements, the fundamental resonance frequency of a mouthpiece, when closed at its large end, can be used as a guide for fine-tuning a mouthpiece. Each mouthpiece from an interrelated set of such fine-tuned mouthpieces bodies has a resonant frequency and a volumetric size that are similar to the other mouthpieces from that set. For different kinds of brass wind instruments, fine-tuned sets each have separate volumetric sizes and separate resonant frequencies.

Ramifications

FIG. 4 to 8 illustrate an unusually wide range of mouthpieces that may be produced by applying the principle of inverse proportionality for a single kind of brass wind instrument. These mouthpieces are played upon with a related instrument just like mouthpieces from prior-art. In contrast to the traditional set shown in FIG. 1 to 3, small cups-chambers are associated with much longer backbore-chambers. Large cup-chambers are associated with much shorter backbore-chambers. FIG. 4 shows the first trumpet mouthpiece made with a calculated backbore length of zero. This unique mouthpiece was specifically constructed to validate the principle of inverse proportionality. It sounds extremely soft and mellow when played on a B-flat trumpet and its overall intonation is as good as prior-art mouthpieces of standard length.

FIG. 9 presents data that compares a set of conventional trumpet mouthpieces from the Yamaha Corporation with the small set of multi-length mouthpieces just described. Yamaha mouthpieces were chosen for comparison because they represent extremes in design not available from the Vincent Bach Corporation. They also resemble the set of mouthpieces depicted in FIGS. 1, 2, & 3. Measured lengths of the Yamaha mouthpieces are nearly identical. By contrast, the inversely-proportioned mouthpieces of FIG. 4 to 8 vary in overall length more than 50%.

Notice in FIG. 9 that the length of each body from FIG. 4 to 8 is inversely-related to respective cup volumes. Since cup volume strongly affects timbre of sound, each successive mouthpiece length produces an increasingly brilliant timbre that is highly correlated with longer increments of length. Sets of traditional fixed-length mouthpieces do not have the advantage of timbre-correlated lengths.

The Yamaha cup-volumes vary by a factor of about 2, whereas FIG. 4 to 8 have cup-volumes that vary by a factor of about 5. Greater variation in cup-volume produces a wider range in the timbre of sound. When desired, additional increments in of size between those of FIG. 4 and 8 produce a larger variety of additional musical timbres. A large set consists of eight trumpet mouthpieces with cup-volumes ranging from 2.5 cc to 0.5 cc that all use the same cup diameter of about 16 mm. Additional sets are created when cups diameters like 18 mm, 17 mm, and 15 mm are substituted according to Step 12 of the first method.

When substituting a Yamaha 14A4a model in place of a Yamaha 14E4 model, a trumpet's tuning slide must be extended by an additional 0.6 cm to maintain a consistent tuning pitch of A=440 Hz. By holding values of d1, d2, and v1 constant, factors that control the intonation of inversely-proportioned mouthpieces also stay nearly constant, regardless of differences in cup volume. When attached to a trumpet, tuning-slide extensions are identical for a fine-tuned set of inversely-proportioned mouthpieces. See FIG. 9 for comparisons. Identical slide extensions mean that musicians need not retune an instrument when switching between any mouthpiece from a set of fine-tuned mouthpieces. Thus, each mouthpiece is equally interchangeable with other members from the same fine-tuned set.

Constructing mouthpieces as inversely-proportioned sets of multi-length mouthpiece bodies brings an entirely new dimension to musical performance. By selecting larger-cup mouthpieces, a trumpet may be induced to sound like a cornet or flugelhorn. Similarly, large changes in timbre are made for other kinds of brass wind instruments. When combined, the advantages of wide-ranging timbres, constant-tuning pitch, and timbre-related lengths provide a unique and powerful synergy of interrelated features not found amongst any sets from prior art.

Similar benefits, as thus far described, also apply to other kinds of brass wind instruments when the principle of inverse proportionality is applied, in turn, to mouthpieces for those instruments. These instruments include piccolo trumpets, cornets, flugelhorns, French horns, baritone horns, euphoniums, trombones, tubas, sousaphones, alto horns, tenor horns, mellophones, bass trumpets, Wagner tubas, and similar brass wind instruments not specifically named. Sets of mouthpieces, for each instrument, have a separate range of physical proportions that relate to separate end-taper standards. The first method can be used to create over two-hundred useful mouthpieces for such instruments when based upon widely-accepted end-taper standards as published by the Vincent Bach Corporation.

For an experienced mouthpiece designer the above descriptions are both specific and fully disclosed. To the extent that the first method may approximate the design of a mouthpiece from prior-art, such a design represents new usage as an incremental member from a correlated set of mutli-length mouthpieces.

ALTERNATIVE EMBODIMENTS

Once the principle of inverse proportionality is fully comprehended, it becomes obvious that alternative methods can be used to design similar sets of multi-length mouthpieces. For example, using divisible parts like those shown in FIG. 10, a designer can simply "mix and match" separately varied cup-sizes and backbore-lengths until suitable combinations are found that worked well with an instrument. Successful combinations are then fabricated as one-piece bodies that can form a set. This alternative method produces similar, but not identical results when compared to mouthpiece designs from the first method. Such an empirical design method simply represents an alternative variation in the physical expression of the principle of inverse proportionality.

Similar sets of mouthpieces can be designed through so-called reverse engineering with computer software for computer-aided-design (CAD) as follows: Predetermine and encode external dimensions for a range of mouthpiece bodies both longer and shorter than the lengths described by the Vincent Bach Corporation. For trumpet, the L3 lengths could be 9.25 cm, 8.25 cm, and 7.75 cm, for example. Then using the constants d1, d2, and v1 with a chosen rim size, experimentally vary the L1/L2 meeting point between a new backbore-chamber and a new cup-chamber (at the center-bore), along the central axis of the mouthpiece body, until chamber volumes v2+v3=v1. L1+L2 should equal length L3. Create a mouthpiece body by using these CAD dimensions. Complete Steps 9 to 12 of the first method. This works because a longer backbore results in insufficient internal air-volume whereas a shorter backbore results in an excessively large internal volume-of-air. A particular advantage of this method is that specific increments lengths may be predetermined. When joined with a prior-art mouthpiece of 8.75 cm, such specific lengths provide a more uniform appearance to an interrelated set of mouthpieces in a way that assists product marketing and sales.

Some trombone players may prefer a shorter range of mouthpiece lengths than the one's calculated in the first method above. This is because trombonists' overall hand-reach-distance for slide positions may be affected by the different lengths of inversely-proportioned mouthpieces. Such sensitive musicians may prefer a re-proportioned design that provide many improvements of inverse proportions while minimizing extremes in length.

To produce such a re-proportioned design (not shown), start with Steps 1 to 10 above. At Step 7, systematically change the L3 length of inversely-proportioned mouthpieces by a percentage difference from the length of the reference standard of Step 1. For example, an inversely-proportioned, shallow-cup tenor trombone mouthpiece with an L3 length of 9.5 cm is reduced by a factor of 50% to 8.7 cm based upon a Step 1 reference standard of 7.9 cm. So, 0.50(9.5−7.9)+7.9=8.7. The length change is made in the backbore-chamber with a corresponding change its end-taper. Similarly, the L3 length for a "short" trombone mouthpiece of 6.9 cm is extended to 7.4 cm. Inner contours of these backbore-chambers and center-bores are then determined empirically in the manner typically used by professional designers of prior-art mouthpieces. Related sets of mouthpieces are completed as usual with steps 11 to 12. This method also demonstrates that a correlated set of inversely-proportioned mouthpieces need not have the same exact lengths as those determined in the 12-step method above, even though lengths calculated in the 12-step method are usually preferred.

Music retailers often resist carrying large varieties of mouthpieces, particularly for instruments like tuba, because the items sell slowly and inventory cost is high. To meet these needs, a set with fewer mouthpieces is created like those described in the following example: Using the procedure of Step 12 above, shape smaller cup-diameters for progressively smaller cup volumes and shape larger cups-diameters for progressively larger cup sizes to produce a single set. Thus mouthpieces of FIGS. 5, 6, 7, & 8 are mated to corresponding cup-diameters of 17.5 mm, 17.0 mm, 16.5 mm, and 16.0 mm, respectively, instead of using a single cup-chamber diameter of 16.0 mm as depicted in FIG. 4 to 8. The same approach is taken separately for each kind of brass-wind instrument.

To adjust perceived blowing-resistance of inversely-proportioned mouthpieces, small tradeoffs between center-bore diameter and backbore size can be made by persons who are highly skilled in the art of customizing brass-wind mouthpieces. Materials like aluminum, wood, or plastic may be used instead of brass machining rod. Finalized shapes may be reproduced using injection molding or other manufacturing techniques.

New Usage for Mouthpiece Variations from Prior Art

Many variations found amongst prior-art mouthpieces are used in new ways to produce alternative embodiments for inversely-proportioned mouthpieces. For example, some highly sensitive brass-wind musicians will prefer to substitute so-called "symphonic" backbore-chambers in place of conic shapes in backbores 51, 61, 71, 81. Expert practitioners of mouthpiece design know how to substitute these backbores. In trumpet mouthpieces, symphonic backbores have outwardly-curved shapes with a profile about half-way between backbores 11 and 21. For inversely-proportioned mouthpieces, symphonic backbores vary in length just like the conic styles that they replace. Their main advantage relates to a slightly different timbre of sound, and to subtle tuning of the highest and lowest notes. This preference exists for a few other brass wind instruments too.

Another embodiment involves additional adjustment or variation of inversely-proportioned mouthpieces by using the old methods of direct-proportionality. Using the new 9.73 cm mouthpiece shown in FIG. 8 for an example, cup 82 and backbore 81 of body 80 are varied in a similar, but less extreme manner as the proportions in FIGS. 1, 2, & 3. Such variation helps adjust a mouthpiece for differences between individual musicians, helps create different qualities of note articulation, and compensates for variations between particular brands of instruments.

FIG. 10 shows several views for the mouthpiece of FIG. 8 in a style similar to U.S. Pat. No. 4,395,933 (1983) of Joseph J. Shepley. Backbore section 101, cup section 102, and rim section 103 all detach and re-attach with screw-threaded fasteners. These sections function in the same manner as a one-piece mouthpiece body when combined. Several mouthpiece makers also feature separable two-piece designs that utilize parts like "top section" 110 and backbore section 101. A "bottom section" 104 has a single, undivided body that attaches to rim 103 with screw-threaded fasteners. New usage of such divisible components for inversely-proportioned mouthpieces will be preferred by some trumpet players, despite the increased costs that accompany such additional features. This new usage applies equally well to inversely-proportioned mouthpieces for all brass wind instruments.

Detachable backbores also convert sectioned mouthpieces from prior-art into inversely-proportioned mouthpieces. By using screw-threaded fasteners, backbores 51, 61, 71, 81 and similar backbores are manufactured as divisible sections. Such multi-length backbore sections are simply substituted in place of fixed-length units like backbore 101. For example, a multi-length set for trumpet (not shown) contains twelve backbore sections that range in length between 5.0 cm to 8.3 cm in systematic increments of 0.3 cm. Such backbores allow musicians to compensate for differences between brands of similar brass wind instruments, in the protrusion of musicians' lips into mouthpieces, and in variations of cup-chamber sizes for the top-sections mentioned above.

There are many devices that help brass-wind musicians make minor adjustments to a mouthpiece. U.S. Pat. Nos. 2,273,177 (1942), 2,758,497 (1956), and 3,808,935 (1974) disclose typical devices that have proved useful. Such devices provide new uses when they are utilized for inversely-proportioned mouthpieces.

The invention has been described in terms of specific embodiments, but it will be apparent to those skilled in the technology of which this invention deals that inversely-proportioned mouthpieces may be embodied in other forms without departing from the true nature of the invention, or from the intended scope of the appended claims and their legal equivalents.

I claim:

1. A set of at least three mouthpieces for a predetermined kind of brass-wind instrument in which individual members of said set thereof have, respectively, contiguously conjoined elements of a rim, a cup-chamber, a backbore-chamber, and an external end-taper, the improvement comprising said individual members each having distinctly non-equal lengths as compared to other said individual members of said set, said individual members each having said external end-taper of a size substantially equal thereto and wherein volumetric sizes of said cup-chamber v2 and of said backbore-chamber v3 are determined by:

a. establishing a predetermined mouthpiece length L3, b. encoding into a computer-aided-design software program predetermined external dimensions of said rim for each said mouthpiece, c. encoding predetermined constants of a center-bore diameter d1, a backbore diameter of d2, and total inner chamber volume v1, as substantially fixed design parameters, and d. experimentally varying cup-chamber length L1 and backbore length L2 until volumetric chamber sizes of v2+v3=v1, as calculated by said computer-aided-design software program, where L1+L2 equals mouthpiece length L3, e. repeating steps a. through d. for each of said individual members of said set.

2. A set of mouthpieces for a predetermined kind of brass-wind instrument, wherein individual members of said set thereof each include, respectively, contiguously conjoined elements of a rim, a cup-chamber, a backbore-chamber, and an external end-taper, and wherein the combined improvement within said set of mouthpieces comprises a set of at least three of said individual members for said predetermined kind of brass wind instrument each having a different length and a different volumetric cup-chamber connecting to a smaller diameter center-bore, such that a first of said members has a shorter length and a larger volumetric cup-chamber size relative to a second of said members having a longer length and a smaller volumetric cup-chamber size thereby defining a relative inversely-proportioned relationship between said length and cup size chamber for each said member within said set, and wherein said individual members each having said external end-taper of substantially equal size configured to fit said predetermined kind of brass wind instrument whereby changes in timbre of sound are strongly achieved through said set as a function of said different mouthpiece lengths and cup-chamber depths for the predetermined kind of brass-wind instrument and provides a visual cue through said different lengths aiding selection of one of said set to meet performance requirements for a particular style of music.

3. The set of mouthpieces for a predetermined kind of brass-wind instrument of claim 2, wherein each mouthpiece has divided parts selected from a group of rim parts, cup-chamber parts, backbore parts, tops parts and bottom parts, said parts having means for fastening at least one of each said parts together to provide each said mouthpiece.

4. The set of mouthpieces for a predetermined kind of brass-wind instrument of claim 2, wherein each mouthpiece has a substantially similar internal volumetric size, wherein internal volumetric size equates substantially to said volumetric cup-chamber size combined with said volumetric backbore-chamber size thereby providing constancy of internal volume and improved intonation qualities of said mouthpieces within said set.

5. The set of mouthpieces for a predetermined kind of brass-wind instrument of claim 2, wherein each mouthpiece has a substantially similar fundamental frequency of resonance when each mouthpiece body is closed shut where said cup-chamber adjoins said rim, thereby providing improved intonation qualities of each mouthpiece within said set.

6. A method of approximating overall length of a mouthpiece for a predetermined kind of brass-wind instrument which includes the steps of:

a. measuring total inner chamber volume (v1) for a given working mouthpiece for said predetermined kind of brass-wind instrument, b. measuring a smallest diameter at a center-bore region (d1) of said given working mouthpiece, c. measuring a largest diameter of a backbore region (d2) of said given working mouthpiece, d. forming a first rim and a first adjoining cup-chamber of one of a larger and smaller size than inner cup-chamber volume of said given working mouthpiece, e. determining an axial length (L1) of said first adjoining cup-chamber, f. measuring inner volume of said first adjoining cup-chamber (v2), g. calculating inner volume of a first chamber bore-volume (v3) by subtracting said inner volume v2 from said total inner chamber volume v1, h. calculating a first backbore-chamber length (L2) according to the following equation:

$$L2 = \frac{3(v3)}{3.1416(R^2 + rR + r^2)} \text{ where } \begin{matrix} r = \frac{1}{2}d1 \\ R = \frac{1}{2}d2 \end{matrix},$$

i. calculating total axial length (L3) for a new mouthpiece body by adding L1 with L2.

7. A method of forming a set of mouthpieces for a predetermined kind of brass-wind instrument, which includes the steps of:

a. measuring total inner chamber volume (v1) for a given working mouthpiece for said predetermined kind of brass-wind instrument, b. measuring a center-bore diameter (d1) of said given working mouthpiece, c. measuring a largest diameter of a backbore region (d2) of said given working mouthpiece, d. forming a first rim and a first adjoining cup-chamber of one of a larger and a smaller size than a cup-chamber volume of said given working mouthpiece, e. determining an axial length (L1) of said first adjoining cup-chamber, f. measuring inner volume (v2) of said first adjoining cup-chamber, g. calculating inner volume of a first chamber bore-volume (v3) by subtracting said volume v2 from said total inner chamber volume v1, h. calculating an axial length of a first backbore-chamber length (L2) according to the following equation:

$$L2 = \frac{3(v3)}{3.1416(R^2 + rR + r^2)} \text{ where } \begin{matrix} r = \frac{1}{2}d1 \\ R = \frac{1}{2}d2 \end{matrix},$$

i. calculating total axial length (L3) for a new mouthpiece body by adding L1 with L2, j. forming a backbore chamber of length L2 onto said first adjoining cup-chamber opposite to said first rim, k. creating a bore in said backbore-chamber having an inner volume v3 where parameters d1, d2, and L2 substantially define said inner volume, l. forming an external end-taper onto an outer surface of said backbore chamber substantially equal to an external end-taper region on said given working mouthpiece, and m. wherein said set is made by substituting an alternative volume for said first adjoining cup-chamber volume v2 and repeating steps d through l.

* * * * *